United States Patent [19]

Vaughn

[11] 4,283,874

[45] Aug. 18, 1981

[54] MUZZLE LOADING FIREARM

[76] Inventor: James C. Vaughn, 394 Yancey Rd., Madison, Ala. 35758

[21] Appl. No.: 99,653

[22] Filed: Dec. 3, 1979

[51] Int. Cl.[3] ..... F41C 27/00

[52] U.S. Cl. ..... 42/51; 42/83

[58] Field of Search ..... 42/51, 83

[56] References Cited

U.S. PATENT DOCUMENTS

| | | | |
|---|---|---|---|
| 3,780,464 | 12/1973 | Anderson | 42/51 |
| 4,114,303 | 9/1978 | Vaughn | 42/83 |
| 4,123,866 | 11/1978 | Wiethoff | 42/83 |
| 4,135,321 | 1/1979 | Lewallyn | 42/83 |

*Primary Examiner*—Charles T. Jordan

*Attorney, Agent, or Firm*—C. A. Phillips

[57] ABSTRACT

A muzzle loading firearm in which firing is effected by a shot shell primer positioned within an ignition chamber and fired through a loosely locked but protective cup.

1 Claim, 7 Drawing Figures

MUZZLE LOADING FIREARM

BACKGROUND OF THE INVENTION

1. Field of the Invention

This invention relates to muzzle loading firearms, and particularly to a firing system for such firearms.

2. General Description of the Prior Art

Heretofore, and perhaps for over a hundred years, muzzle loading firearms have been fired or ignited by means of a percussion cap 80 (FIG. 5). Percussion cap 80 has a slightly tapered case 82 with a closed (smaller) end 84 and an explosive charge 86 which is positioned within case 82 adjacent to end 84. The opposite end 88 is open and is adapted to fit over a tubular holder 90 (in turn adapted to be screwed into the breech end of the barrel of a firearm) having an opening 91 which connects with the interior of the barrel of the firearm. Percussion cap 80 is fired by hammer 92 by simply compressing charge 86 between closed end 84 of the percussion cap and the top surface of holder 90. The resulting flame is then directed through opening 91 to the interior of the barrel of the rifle to fire a propellant therein. It is well known that the percussion cap system is not highly reliable and that misfires not infrequently occur. A further difficulty is that a part of the explosion can leak out between the wall of case 82 and holder 90, and it is necessaary to provide a shroud 94 on hammer 92 to provide a measure of protection for the user of the firearm. In a previous application, now U.S. Pat. No. 4,114,303, the applicant disclosed one device for utilizing a shot shell primer in an improved firing system, and it is basically illustrated in FIG. 2.

It is the object of this invention to provide a modification of the applicant's prior system, particularly enabling a shot shell primer to be useable with weapons which have a flat surfaced hammer, and to provide improved certainty and safety of firing.

SUMMARY OF THE INVENTION

In accordance with this invention, a muzzle loading firearm is equipped with a tubular ignition chamber in place of a percussion cap holder, and this chamber is formed in a tubular member which screws into an opening in the breech of the firearm. The tubular member includes an opening which extends from end to end and cooperates with the opening in the breech of the firearm. As attached, the outer end of the opening in the tubular member is enlarged to accept the barrel of a shot shell primer, and an outer planar surface of the tubular member supports the flanged end of the shot shell primer. The cup-shaped striking end of the hammer of the firearm is eliminated and the hammer may simply be flat. Instead, a cup-shapped enclosure is loosely threaded over the casing of the ignition chamber. The inner surface of the enclosure employs a small protrusion which strikes a centrally located membrane on the flanged end of the shot shell primer. Since the explosive of the shot shell primer is contained by the tubular member of the shot shell primer itself, the chamber in which it is positioned and the cup-shaped enclosure, its explosive force is very safely contained.

DETAILED DESCRIPTION OF THE DRAWINGS

Figure 2:
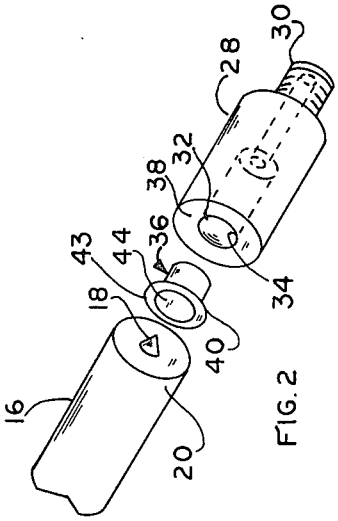
FIG. 2 is an exploded pictorial view showing basic elements of the ignition system of the applicant's prior patent as a related arrangement.

Referring to FIGS. 1 and 3–5, muzzle loading firearm 10 has a conventional barrel 12 and trigger assembly 14 for cocking and releasing hammer assembly 16. The end surface of hammer end 20 is flat in accordance with the present invention in contrast to having a pointed protrusion 18 as illustrated in the applicant's prior device as illustrated in FIG. 2. There is an opening 22 between the exterior 23 and interior (or bore) 24 of barrel 12, opening 22 having a threaded region 26 into which is threaded and thereby attached igniter barrel 28, attachment being by means of externally threaded end region 30. In the applicant's prior patent device shown in FIG. 2, igniter barrel 28 includes an opening 32 which communicates with opening 22 of firearm barrel 12, and opening 32 has an enlarged region 34 adapted to conform to the outside diameter of a conventional shot shell primer 36. The top or outside end surface 38 of igniter barrel 28 is planar, lying in a plane generally perpendicular to opening 32, and thus shot shell primer 36 is positionable, for firing, within enlarged region 34 with flange 40 of the primer supported by end surface 38 of igniter barrel 28.

Shot shell primer 36 contains an explosive 42 in engagement with a thin metal membrane 44, centrally positioned in an end closure 43 of shot shell primer 36, interior of flange 40 of the closure.

Referring to FIGS. 1 and 3–7, particularly illustrating the present invention, igniter barrel 96 utilizes a conventional shot shell primer 36 in end opening 100. Igniter barrel 96 is identical to igniter barrel 28 (FIG. 2) except that end region 102 is reduced in diameter as external threads 104. Threads 104 are adapted to receive cup 108 which has threads 106 adapted to loosely thread with threads 104 and permit some axial play between cup 108 and barrel 96. Cup 108 has a protrusion 112 on the inner side of its end 110 which is positioned adjacent to firing membrane 114 of shot shell primer 36. Thus, with cup 108 screwed down so that protrusion 112 is against membrane 114, if hammer 116 (mounted on hammer assembly 16) strikes cup 108, cup 108 will be driven downward. In view of the play in the threaded connection between cup 108 and barrel 96, cup 108, and thus protrusion 112, will be driven downward, and protrusion 112 will engage membrane 114 with sufficient force to fire shot shell primer 36.

Figure 7:
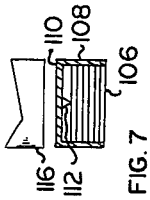
FIG. 7 is a sectional view along lines 7—7 of FIG. 3.
Figure 6:
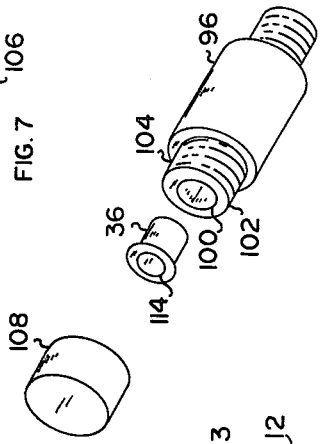
FIG. 6 is an exploded view of the principal component of this invention.
Figure 3:
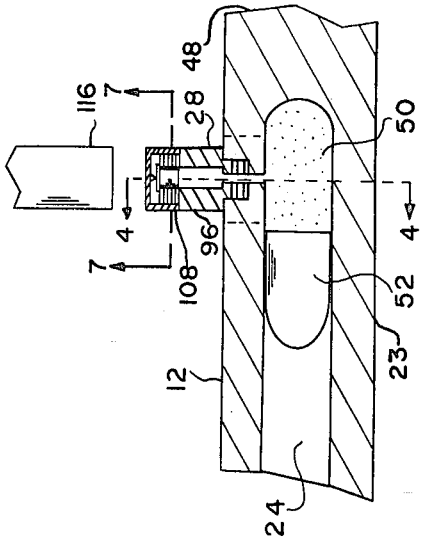
FIG. 3 is a sectional view along lines 3—3 of FIG. 1 and showing in exploded form certain elements of the firing system.
Figure 4:
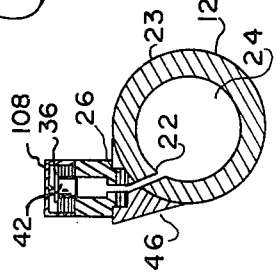
FIG. 4 is a sectional view along lines 4—4 of FIG. 3.
Figure 5:
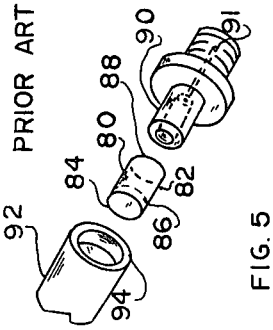
FIG. 5 is an exploded view illustrating prior art.

Opening 22 extends diagonally upward from bore 24 through an enlarged side wall portion 46 of the barrel, as shown in FIG. 4. Typically, the bottom end of opening 22 enters bore 24 near breech end 48 of the barrel where an explosive charge 50 would be ignitable through the opening to fire a projectile 52. Opening 22, of course, communicates with opening 100, and the combined openings generally extend in a direction normal to bore 24. Thus, the resulting explosion is directed downward through opening 22 to thereby fire explosive charge 50 in barrel 12. As will be noted, in contrast to an explosion being external to an opening 22 or 32, which would have been the case with a compression cap type firing device, the igniting explosion is completely contained, enabling a most reliable and safe firing or firearm 10. By virtue of the locked state between threads 104 and 106, again significant disengagement, additional protection against an external explosion is achieved.

Figure 1:
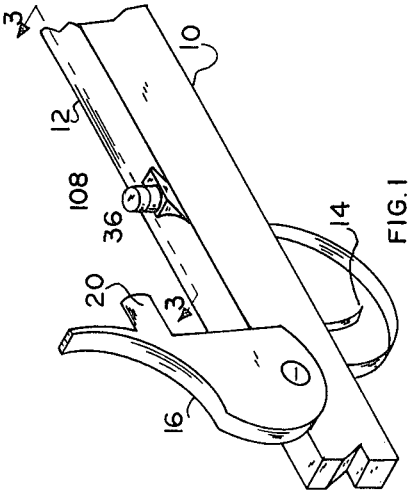
FIG. 1 is a pictorial view of a portion of the breech of a muzzle loading firearm employing the ignition or firing system of the present invention.

To effect firing, shot shell primer 36 is positioned in opening 100 of igniter barrel 96, and with hammer assembly 16 cocked as shown in FIG. 1, trigger 14 would be pulled, causing hammer assembly 16 to move clockwise, in turn causing hammer 20 to strike cup 108 and be drawn against shot shell primer 36 due to the loose fit between threads 104 and 106. This causes protrusion 112 to impact shot shell primer 36. This causes the explosive in it to ignite, directing a flame downward through opening 22 to thereby fire explosive charge 50 in barrel 12. As will be noted, in contrast to an explosion being external to an opening 22 or 32, which would have been the case with a percussion cap-type firing device, the igniting explosion is completely contained, enabling a most reliable and safe firing of firearm 10. By virtue of the locked state between threads 104 and 106 against significant disengagement, additional protection against an external explosion is achieved.

I claim:

1. A muzzle loading firearm comprising:

a firearm barrel having a breech region through which there is an opening running from exterior to interior of the barrel, and the interior wall of at least an outer end region of said opening being threaded;

an elongated tube having:

said tube terminating in a plane surface at one end adjacent to said first end region, which plane surface lies generally normal to the direction of said opening, and first and second ends of said tube being threaded, and said first end being adapted to mate with said interior threaded opening in said barrel;

a cup having a protrusion on its inner end surface and having inner side wall threads adapted to loosely thread over said second end of said elongated tube;

a shot shell primer comprising:

a tubular body having an outer diameter corresponding to the inner diameter of said first end region of said elongated tube, an explosive charge contained within said tubular body, a generally flat, circular end member closing one end of said tubular body and extending radially outward from said tubular body to form a flange, and said end member including a central membrane adapted to communicate a firing force to said explosive charge when struck, and said tubular body is positioned within said first end region of said elongated tube with said flange resting against said plane surface of said elongated tube; and spring loaded hammer means supported by said barrel for applying a small area force to said central membrane of said shot shell primer;

whereby, when operated, said hammer means provides a force which is communicated through said cup to said membrane to ignite said explosive charge within said elongated tube, which tube in turn effectively provides a single exit path for the ignited explosive to the interior of the breech of the barrel, enabling a projectile propellant therein to be reliably fired.

* * * * *